US005617077A

United States Patent [19]

Wiemeyer et al.

[11] Patent Number: 5,617,077

[45] Date of Patent: Apr. 1, 1997

[54] TESTABLE PHOTOELECTRIC DETECTOR

[75] Inventors: James F. Wiemeyer, Homer Township; Mark Bohanon, Lisle, both of Ill.

[73] Assignee: Pittway Corporation, Chicago, Ill.

[21] Appl. No.: 434,567

[22] Filed: May 3, 1995

[51] Int. Cl.[6] ..... G08B 17/10

[52] U.S. Cl. ..... 340/628; 340/630; 250/573; 250/574

[58] Field of Search ..... 340/628, 629, 340/630; 250/572, 573, 574, 576

[56] References Cited

U.S. PATENT DOCUMENTS

| | | | |
|---|---|---|---|
| 4,321,466 | 3/1982 | Mallory et al. | 250/574 |
| 4,651,013 | 3/1987 | Kajii et al. | 250/573 |
| 4,725,148 | 2/1988 | Endo et al. | 250/573 |
| 4,827,247 | 5/1989 | Giffone | 250/574 |
| 5,053,754 | 10/1991 | Wong | 340/632 |
| 5,381,130 | 1/1995 | Thuillard et al. | 340/630 |
| 5,473,167 | 12/1995 | Minnis | 340/630 |

*Primary Examiner*—Jeffery Hofsass
*Assistant Examiner*—Ashok Mannava
*Attorney, Agent, or Firm*—Dressler, Goldsmith, Milnamow & Katz, Ltd.

[57] ABSTRACT

A self-testable photoelectric smoke detector incorporates a housing which defines an internal smoke chamber. The housing carries a laser diode and a radiation sensor along with a supplemental source of test radiant energy. When a test is initiated, the operational characteristics of the laser diode are monitored simultaneously with energizing the source of test radiant energy. Signals from a scattered radiant energy sensor are evaluated via control circuitry, along with signals indicative of performance of the laser diode to determine whether or not the laser diode as well as the radiation sensor are functioning properly.

5 Claims, 2 Drawing Sheets

FIG. 2
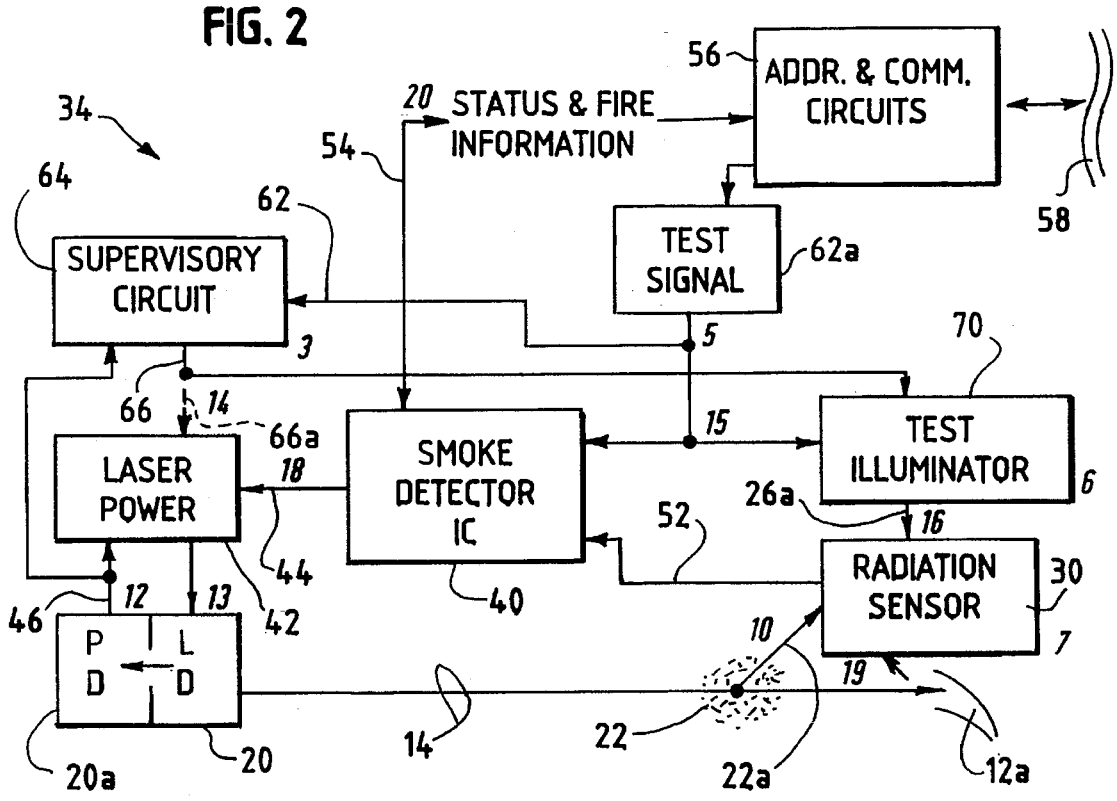
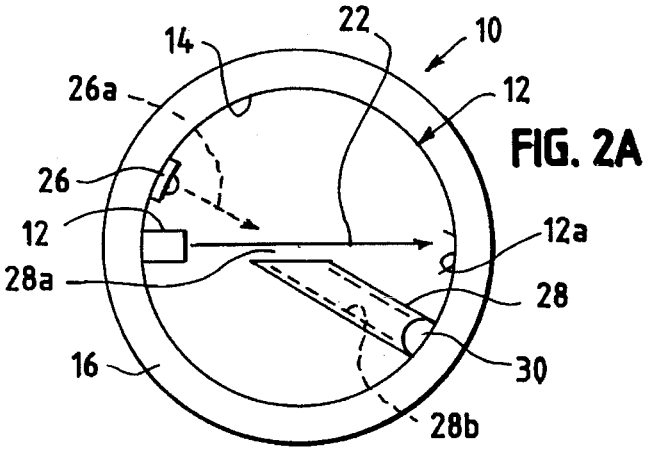
FIG. 2A
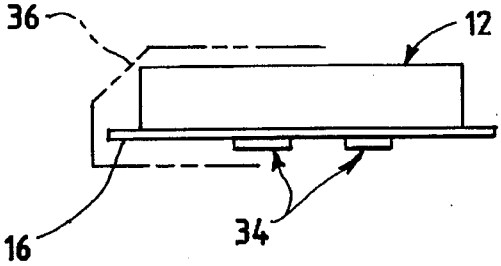
FIG. 2B

TESTABLE PHOTOELECTRIC DETECTOR

FIELD OF THE INVENTION

The invention pertains to testable photoelectric smoke detectors. More particularly, the invention pertains to such detectors wherein a supplemental source of radiant energy and a local monitoring signal are used to create a test condition.

BACKGROUND OF THE INVENTION

Photoelectric smoke detectors have been recognized as being useful in providing signals indicative of concentrations of smoke or particles of combustion in the ambient atmosphere. Such detectors can be used alone or in groups to provide an indication of a developing fire condition.

Known photoelectric smoke detectors often provide circuitry for testing the respective detector. Various types of test circuitry are known.

The graph of FIG. 1 contains 2 curves, i.e. curve A and curve B. The units for smoke concentration and radiation sensor signal appear in arbitrary units; the ranges of values are chosen for illustration.

Curve A depicts a typical photoelectric smoke detector's radiation sensor output as a function of smoke concentration. In the absence of smoke (smoke concentration=0), the radiation sensor generates a nonzero output (shown 0.2) resulting from background reflections of radiation inside the smoke detection chamber. The reflected radiation originates from the internal radiation source, reflects from the inside walls of the chamber, and finally irradiates the radiation sensor to produce a nonzero output.

A known "self test" technique employs a higher radiation sensor amplifier gain during a "self test" mode, so that the amplifier output simulates the presence of smoke within the detection chamber. For example, a "test" gain whose magnitude is greater than "normal mode" gain by a factor of 6 would exceed an alarm threshold corresponding to a smoke concentration of 1 in the absence of smoke. This follows since six times the 0.2 radiation sensor signal yields a signal of 1.2. In "normal mode", the detector requires a smoke concentration of 1.0 to cause a radiation sensor signal of 1.2.

Curve B of FIG. 1 depicts a photoelectric smoke detector's radiation sensor output, when the optics employ a tightly focused laser diode, a radiant energy source, specifically arranged to minimize unwanted background reflections. In the absence of smoke (smoke concentration=0), the radiation sensor generates a zero output, or an output very small in magnitude. Such a small radiation sensor output renders the above described "self test mode" smoke simulation technique problematic or even nonfunctional.

One known solution to the "self test" problem inherent in low background noise photoelectric detectors utilizes a separate "test" radiation source to directly or indirectly irradiate the sensor. Such schemes fail to assess the proper operation of the "normal" radiation source, i.e. the laser diode.

There continues to be a need for circuitry and methods of testing low background noise photoelectric smoke detectors which can also take into account the level of functioning of the radiant energy source for the detector. Preferably, such circuitry could be incorporated into low background noise photoelectric detectors without undue expense and without detracting in any way from the performance of such detectors.

SUMMARY OF THE INVENTION

In accordance with the invention, the proper operation of the laser diode can be verified by using an internal photodiode monitor contained within available commercial laser diode packages. The photodiode monitor internal to such laser diode packages generally provides a signal for active regulation of the laser diode optical output.

Where a laser diode is incorporated as a source of radiant energy into a photoelectric detector, the photodiode monitor signal may also be used to report laser diode status for "self test" and other supervisory purposes. The laser diode monitoring circuit can be used in conjunction with a separate source of radiant energy used to create a test condition.

In accordance with the one aspect of the invention, a photoelectric detector includes: a housing which defines an interior volume; a semiconductor source of radiant energy carried within said housing wherein said source includes an integrally formed self-monitoring circuit and wherein a portion of said circuit is coupled to an accessible conductor; and a separate supervisory circuit with an input port for receipt of control signals wherein said circuit is coupled to the accessible conductor and wherein the circuit provides an output in response to the presence of both a selected signal from said conductor and a selected control signal.

These and other aspects and attributes of the present invention will be discussed with reference to the following drawings and accompanying specification.

BRIEF DESCRIPTION OF THE DRAWING

FIGS. 2A, 2B are top and side views respectively, of a detector in accordance with the present invention; and FIG. 3 is a block diagram of a system, in accordance with the present invention.

DETAILED DESCRIPTION OF THE PREFERRED EMBODIMENT

Figure 1:
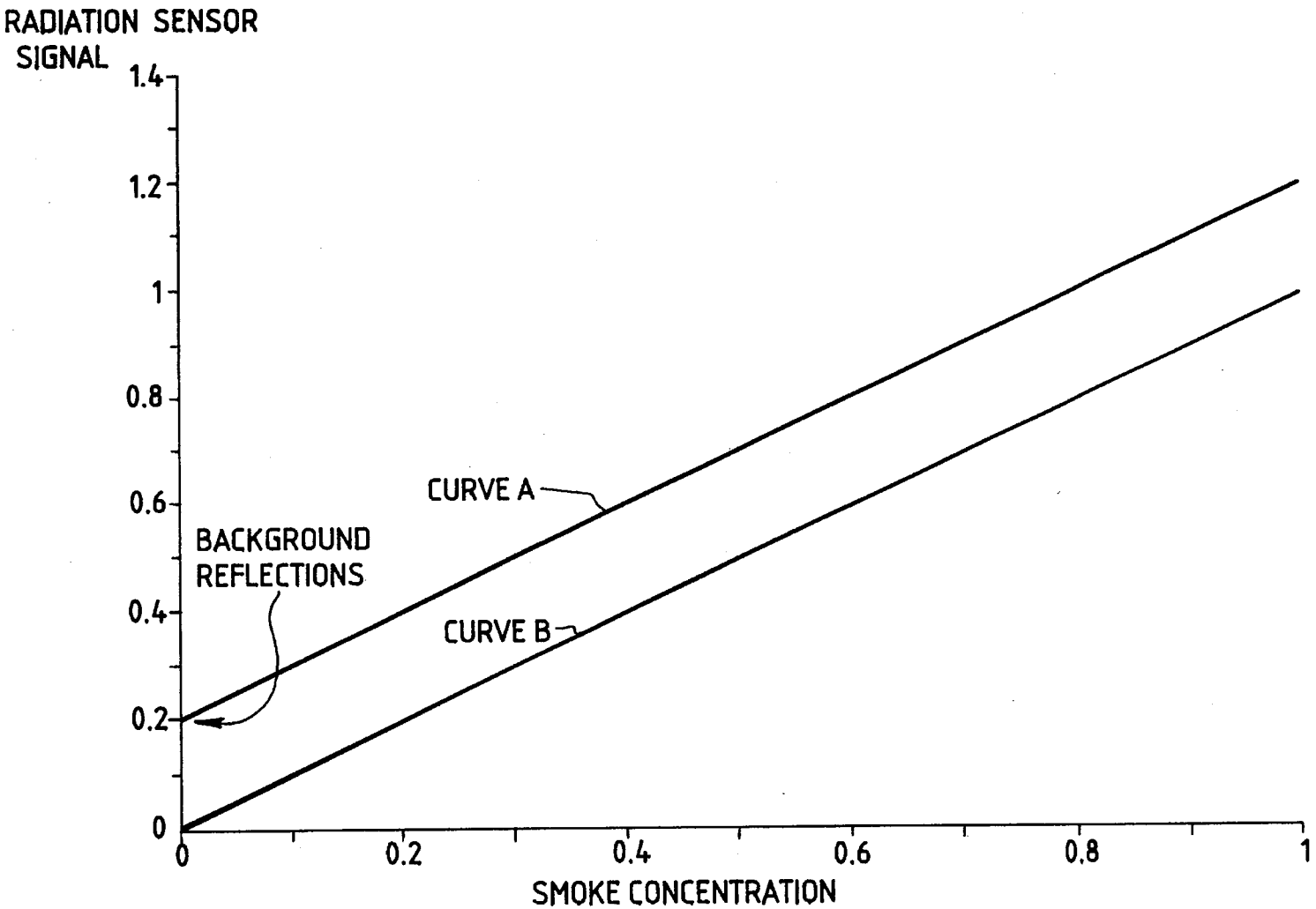
FIG. 1 is a graph illustrating outputs from two types of known photoelectric detectors.

While this invention is susceptible of embodiment in many different forms, there are shown in the drawing, and will be described herein in detail, specific embodiments thereof with the understanding that the present disclosure is to be considered as an exemplification of the principles of the invention and is not intended to limit the invention to the specific embodiments illustrated.

FIGS. 2A and 2B depict a photoelectric detector 10 in accordance with the present invention. The detector 10 includes an optics housing 12 which defines an internal volume 14, a smoke chamber. The housing 12 is carried on a printed circuit board 16.

A source of radiant energy, a laser diode 20 with integral monitoring circuitry is carried on the housing 12. The source 20 emits a beam of essentially monochromatic radiant energy 22 across the internal volume 14 to a light trap 12*a*. The light trap 12*a* minimizes unwanted internal reflections from the beam 22.

A collector or shroud 28 is provided to minimize stray or unwanted reflected light falling upon a sensor 30. The sensor 30 is intended to detect radiant energy from the beam 22 which has been scattered by smoke particulate matter which has entered the smoke chamber 14.

The shroud 28 can be formed as an elongated, cylindrical, tubular member with an open end 28*a* to provide for entrance of scattered radiant energy. For purposes of improving signal-to-noise ratio, an internal surface 28*b* (illustrated in phantom) can be provided with a reflective coating or form of a reflective metal so as to increase the level of scattered radiant energy incident upon the sensor 30.

Coupled to the source 20 and the sensor 30 are control circuits 34. The unit 10 can be enclosed within an external housing 36, illustrated in phantom in FIG. 2B, for aesthetic purposes and also to protect it from damage.

Offset from the laser diode 20, is a test light emitting diode 26 which is also carried on the housing 12. The test light emitting diode 26 is energized and provides a beam of radiant energy 26*a* which is used solely to test the operation of the sensor 30.

The beam of test radiant energy 26*a* is emitted in a direction which causes it to be more or less directly incident upon the sensor 30. The test light emitting diode 26 is not energized during normal operation of the detector 10.

The electrical circuit block diagram of FIG. 3 illustrates circuitry 34 that assesses a laser diode's performance status via a monitoring signal. An acceptable laser diode status is required to avoid generation of a system "trouble" signal.

During normal operation, a smoke detector integrated circuit 40, such as a Motorola MC145010 or 145011 I.C., periodically signals a laser power supply 42 via a line 44 to energize the laser diode 20. The laser diode 20 contains an integral monitor photodiode 20*a* which provides feedback information pertaining to laser output radiation on a line 46 to the laser power unit 42.

The laser power supply 42 modifies the quantity of power delivered to the laser diode 20, based upon the feedback information, such that the laser generated radiant energy 22 attains a predetermined power level programmed into the laser power supply 42. The laser diode 20 could be, for example, a Rohm RLD-78 MAT1 laser diode with an integral monitoring circuit.

In the normal mode, and in the absence of smoke, the laser radiation 22 propagates into the radiation trap 12*a* such that only a very small quantity of stray radiation irradiates the sensor. By "very small quantity" it is meant that the output of the radiation sensor 30 lacks enough magnitude to readily accomplish the described "self test" function, via increased amplifier gain within the smoke detector IC 40.

The smoke detector IC 40 receives radiation sensor signals and information on a line 52 and processes the information, perhaps in conjunction with other system information, to determine and send status and/or fire information output signals on a line(s) 54. More than a single output is possible. Indicating lamps and audible transducers can be energized by one or more of the line(s) 54.

The signals on the line(s) 54 can also be coupled to address and communication circuits 56 where the unit 10 is part of a larger fire alarm system. The circuits 56 can be in bidirectional communication with a communications link 58 of a known type. One form of communications system is disclosed in Tice et al., U.S. Pat. No. 4,916,432 which is assigned to the assignee of the present invention and which is incorporated herein by reference.

In the normal mode and in the presence of smoke, the behavior of the detector 10 resembles the behavior of the detector in the absence of smoke, except that the smoke particles interact with the laser radiation 22 to produce scattered radiation 22*a*. That scattered radiation irradiates the sensor 30, which in turn generates a signal, on the line 52, indicative of the amount of scattered radiant energy for use by the smoke detector IC 40. The smoke detector IC 40 processes the information, perhaps in conjunction with other system information, to produce a fire indicating output signal and perhaps status or supervisory information on the line(s) 54.

A test signal, generated on a line 62 from test signal circuitry 62*a*, puts the smoke detector IC 40 into a "test mode". The signal on the line 62 could be generated locally or in response to a command from the remote alarm system control unit. In this instance, the system functions similarly to the normal mode, but some additional activity occurs.

The laser diode monitor status information, from the photodetector 20*a*, is coupled to supervisory circuitry 64 via the line 46. The supervisory circuitry 64 processes the status information in conjunction with the test signal on the line 62 to produce at least one output on a line 66, which optionally may disable laser power from the supply 42 from reaching the laser diode 20 (illustrated in phantom via line 66*a*).

The output signal from the supervisory circuitry is processed by a test illuminator circuit 70, in conjunction with the test signal line 62, to produce a corresponding quantity of test radiation 26*a*. The radiation 26*a* is produced when the test illuminator circuit 70 energizes the test light emitting diode 26.

The test radiation 26*a* irradiates the radiation sensor 30, which in turn sends radiation information to the smoke detector IC 40. The smoke detector IC 40 processes the available information, to generate a fire condition indication on the line(s) 54. A suitable output indicates that the detector 10 has satisfactorily passed the test.

The smoke detector IC 40 optionally may employ a high "test mode" gain in the test mode. However, the test illumination circuit 70 provides ample stimulus, via the test beam 26*a*, for the radiation sensor 30 to produce large magnitude signals for processing by the IC 40 without resorting to use of a higher than "normal mode" gain.

During test mode, if the supervisory circuitry 60 detects an improper status condition for the laser diode 20, then the supervisory circuit 64 can disable the test illuminator circuit 70. In this instance, no radiation irradiates the sensor 30.

The sensor information processed by the IC 40 may be interpreted as indicating unsatisfactory system operation. The smoke detector IC 40 then reports a "trouble" condition, or a zero smoke concentration level on the line(s) 54. This output signal may, in turn, be interpreted as a "trouble" condition detected during a test. A faulty radiation sensor 30 could produce a similar output.

The "trouble" output(s) can be communicated, via communications circuitry 56 and link 58 to the remote fire alarm control unit. Further tests can then be carried out or the detector can be removed and checked.

During the test mode, if the supervisory circuitry 64 detects proper laser diode status, then the supervisory output, line 66, may be chosen to enable the test illuminator circuit 70. If all system components operate properly, then the status and fire information signals, line(s) 54, report the correct predetermined degree of simulated smoke. In this case simulation refers to the test illuminator 70 producing a quantity of radiation 26*a* to produce a radiation sensor 30 output equal, via line 52, to the radiation sensor output in the presence of a predetermined concentration and type of smoke. Thus, the operation of the laser diode 20 as well as the sensor 30 can be monitored during the test condition.

It will be understood that other monitoring or supervisory functions can be carried out in accordance with the above, without departing from the spirit and scope of the present invention. It will also be understood that some or all of the circuitry 40, 64 could be implemented using one or more interconnected integrated circuits or, alternately, by a programmed microprocessor.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A photoelectric smoke detector comprising:

a housing which defines an internal volume;

a radiant energy element carried by said housing wherein said element includes a source of radiant energy, a part of said radiant energy is directed into said volume, and an attached photodetector wherein another part of said radiant energy from said source is incident on said detector thereby providing an electrical signal indicative of said radiant energy with said element including a common casing for said source and said photodetector;

a sensor of radiant energy spaced from said element, carried in said housing, and oriented to detect substantially only radiant energy from said source which has been scattered by ambient smoke; and control circuitry coupled to said element and said sensor wherein said control circuitry energizes said source, at least intermittently, and wherein said control circuitry includes circuitry to monitor said electrical signal from said photodetector to verify proper operation of said source so as to provide a test enabling signal on a selected electric line to permit a test of said sensor only in response to proper operation of said source.

2. A smoke detector as in claim 1 which includes a power supply for said source and wherein said control circuitry includes circuits for adjusting a level of electrical energy supplied to said source in response to said electrical signal.

3. A smoke detector as in claim 2 which includes a test source of radiant energy, displaced from said source, and coupled to said control circuitry wherein said test source is energized only in response to a test condition and in response to proper operation of said source.

4. A detector as in claim 1 which includes a second source for the generation of a test beam of radiant energy directed onto said sensor wherein said second source is coupled to said control circuitry and can be intermittently energized only in response to the presence of said test enabling signal.

5. A detector as in claim 4 wherein said control circuitry includes circuitry for indicating proper operation of first said source and subsequently proper operation of said sensor where said sensor produces a selected output in response to radiant energy incident thereon from said test source.

* * * * *